US005955969A

United States Patent [19]

D'Hont

[11] Patent Number: 5,955,969

[45] Date of Patent: Sep. 21, 1999

[54] METHOD TO PREVENT ROUGE TRANSPONDER RESPONSES IN AUTOMATIC VEHICLE IDENTIFICATION SYSTEMS

[75] Inventor: Loek D'Hont, Plano, Tex.

[73] Assignee: Texas Instruments Incorporated, Dallas, Tex.

[21] Appl. No.: 08/826,913

[22] Filed: Apr. 9, 1997

[51] Int. Cl.[6] ..... G08G 1/00

[52] U.S. Cl. ..... 340/928; 235/384; 370/286; 375/346; 455/1; 455/63

[58] Field of Search ..... 340/928, 933; 235/384; 370/201, 286, 287; 375/296, 346, 348; 455/1, 63, 67.3, 41, 296; 342/14, 19; 379/3

[56] References Cited

U.S. PATENT DOCUMENTS

| | | | |
|---|---|---|---|
| 4,317,214 | 2/1982 | Attinello | 455/67.3 |
| 5,406,275 | 4/1995 | Hassett et al. | 340/928 |
| 5,659,609 | 8/1997 | Koizumi et al. | 379/3 |
| 5,675,342 | 10/1997 | Sharpe | 340/928 |
| 5,701,127 | 12/1997 | Sharpe | 340/928 |

*Primary Examiner*—Brent A. Swarthout
*Attorney, Agent, or Firm*—Rebecca Mapstone Lake; Richard L. Donaldson

[57] ABSTRACT

A method of preventing a response to a rouge poll message in an AVI system is presented. The method entails that during the transmission of the poll message from the interrogator to the transponder, wherein the poll message reflects off an undesirable position, thereby creating the origination of an undesirable poll message, i.e. a poll message which will be received by a wrong transponder, a jamming signal is also transmitted at the same frequency and from the point from which said reflected poll message originates. The jamming signal and the poll message create a rogue poll message as received by the transponder wherein at least one bit within the transmitted poll message is flipped. Transponders, upon receiving said rogue poll message, calculate the CRC and compare the calculated CRC with the received CRC. The rogue message should yield an invalid CRC, i.e. a CRC unlike the received CRC, and therefore, the transponder will fail to respond to the jammed poll message.

24 Claims, 1 Drawing Sheet

METHOD TO PREVENT ROUGE TRANSPONDER RESPONSES IN AUTOMATIC VEHICLE IDENTIFICATION SYSTEMS

FIELD OF THE INVENTION

This invention relates in general to RF-ID systems and more specifically to a method for preventing rouge tag responses in an Automatic Vehicle Identification (AVI) type of recognition system.

BACKGROUND OF THE INVENTION

The invention will be described in the context of an Automatic Vehicle Identification (AVI) system capable of exchanging data codes between an interrogator(reader) and a transponder(tag). The AVI field is but one environment in which the inventive concepts described herein can be applied. Systems using batteryless transponders or transponders with batteries may be used for identifying or locating objects bearing the transponders such as cattle, luggage, manufactured goods, or other items. Further, the transponder might provide status information regarding the object on which it is located, such as a transponder disposed on a car door indicating whether the car door is open. Transponders utilized in the above recognition systems or others may be powered from batteries or from wireless radio frequency (RF) signals.

With respect to AVI systems, generally the interrogator is provided in a toll booth of a toll road, parking garage or other limited access facility. The interrogator(reader) identifies passing automobiles by sending wireless interrogation signals to a transponder (tag), which would normally be a small, self-contained unit placed, for example, on the dashboard or windshield of the car. In this way the car (or other vehicle or object) can be identified in a speedy and efficient manner. Depending on the use of the system, an account associated with the driver, owner or other designated person can be debited an access charge. Compatibility standards for one such AVI system is set out in Title 21, Division 2, Chapter 16, Articles 1–4 of the California Code of Regulations, herein known as the Caltrans specification or Caltrans spec.

With respect to the specific embodiment, which is compatible with the Caltrans spec, the minimum role of the interrogator is to: 1) trigger or activate a transponder; 2) interrogate a transponder for specific information; and 3) provide an acknowledgment message to the transponder after a valid response has been received by the interrogator. The immediate mandate of the Caltrans spec covers electronic toll collection, sometimes described as part of "Electronic Tolls and Traffic Management" (ETTM). The AVI equipment for toll collection will typically consist of two functional elements: vehicle-mounted transponders and fixed position interrogators.

A toll collection site will consist of at least one interrogator operating in the role described above. Upon interrogating or "polling" a transponder for specific information such as a transponder identification (ID), the interrogator (or separate computer) will typically check the transponder ID against a database of valid, non-delinquent accounts. If the transponder ID is valid and not delinquent, the interrogator will send a signal to a gate mechanism, or a toll site computer operating such a gate mechanism to allow the car to pass. Of course other enforcement means are possible which may allow for less interruption of traffic, such as allowing all cars to pass and identifying the auto carrying the transponder (or the rouge automobile carrying an inoperable transponder or no transponder at all) by other means and notifying an appropriate enforcement agency.

The interrogation signal and response signal comprise data codes. The Caltrans spec has set forth definitions for data codes to be transmitted between the interrogator and the transponder. The data codes described below are derived from the Caltrans spec and are merely exemplary and intended to be neither an exhaustive nor a mandatory list of codes for a general AVI system.

(a) Agency Code: This 16-bit code field identifies the agency that has the authority to conduct this transaction;

(b) Error Detection Code: The error detection code may be CRC-CCITT-16, with a generator polynomial of X+X+1. This results in a 16-bit error detection code transmitted with each data message;

(c) Header Code: The Header is generally the first field in each data message for either reader or transponder transmissions and consists of an 8-bit and a 4-bit word for a total of 12 bits. The Header provides a "selsyn" signal that may be used by a receiver with a transponder or interrogator to self-synchronize (selsyn) with the data being received from the interrogator or transponder, respectively. An exemplary selsyn signal might be the binary and hexadecimal values: 10101010 and AA respectively;

(d) The Header Flag code provides for a unique, 4 bit Flag that is recognized by a transponder or interrogator decoder as the end of the Header with the data message to follow. The exemplary Flag signal has binary and hexadecimal values: 1100 and C respectively;

(e) Interrogator ID Number: This 32-bit field is used to uniquely identify the interrogator conducting the transaction;

(f) Transaction Record Type Code: This 16-bit code uniquely identifies a specific type of valid transaction between a reader and a transponder. This code uniquely defines the transponder message fields and functions permissible. By way of example, hexadecimal numbers 1 through 7FFF may be set aside for transponder message structures and 8000 through FFFF may be dedicated for reader-to-transponder message structures;

(g) Transaction Status Code: Used to provide status information to the transponder; and (h) Transponder ID Number: This 32 bit code uniquely identifies which transponder is responding to a polling request or is being acknowledged.

Because the transponder typically either derive their operating power from a small battery, or from a received Radio Frequency (RF) signal, the transponders are not normally active. Instead, the interrogator will transmit an RF trigger pulse to activate (turn-on) the transponders in approaching cars or other objects. The interrogator may transmit a number of RF trigger pulses at regular intervals to wake up any approaching transponders. Alternatively, the interrogator might send an RF trigger pulse in response to an external stimulus to the interrogator indicating that a transponder is approaching (e.g. light, heat, or magnetic sensors). After a time delay, the reader then will transmit an encoded signal, referred to as the Polling message or interrogation which, upon detection and decoding by the transponder, will provide initial information to the transponder as to which data blocks the transponder should transmit.

In a described embodiment, the interrogator transmits an unmodulated continuous wave RF signal as an interrogation signal to the transponder while waiting for the transponder response signal. BY analog to acoustic signals, an unmodulated RF signal is similar to a constant or "pure" musical tone without any variation in amplitude or frequency. However, it should be mentioned that a signal could be considered "unmodulated" in amplitude even if varying in frequency and vice-versa. The transponder response signal in this embodiment comes when the transponder backscatter modulates the continuous wave RF signal with information from the transponder. Following the acoustic analogy, backscatter modulation is similar to the phenomenon achieved by singing into a fan and listening to the resulting sound. Typically when a person sings, they control the variations or modulations of their voice. Similarly, an RF transmitter is generally able to modulate its signal. However, when a person sings into a fan, the blades of the fan will reflect the sound of the voice immediately back to the person when the blades pass immediately in front of his mouth. Thus, the singer hears a chopping sound superimposed on his voice. That "chopping" sound the signer hears is nothing more than the amplitude variation of the reflection of the sound of his voice. Similarly, the transponder can modulate (by amplitude or other means) the continuous wave RF signal transmitted by the interrogator and this reflected signal will have modulations superimposed on it.

Some of the problems encountered in a toll tag system are only exemplified when the toll booth comprises a canopy which overhangs the toll plaza. The canopy presents a perfect reflective medium for any transponder response or interrogation signal which is transmitted from either the transponder or the interrogator respectively. Furthermore, for automatic toll collection systems, it is essential that a tag responds only in a certain area (i.e. time window) of a toll lane, in order to perform the billing process properly. For example, if a tag responds too early due to reflections off other objects present in the toll lane, the ETC lane sensor sequencing will be messed up, and the wrong car will be billed with the wrong toll transaction which is absolutely not allowed in a toll application.

In a canopy toll booth situation, car 2's tag can be read when the antenna boresight signal (the strongest in the antenna pattern) bounces off vehicle 1's roof. Just lowering the transmitter power to prevent this problem is not enough, because the antenna lane coverage (at the lateral lane edges) might become jeopardized in that case. Also an "RF focusing" effect (depending on road and canopy shape) might be present at a toll plaza, making the reflected signal at car 2 even stronger than at car 1, no matter what power interrogation signal is transmitted.

One prior art solution to the problem of "early read" comprises the use of an extra lane sensor which turns the reader on ONLY when the car is really under it. However, this method is not very reliable because reflection reads are still possible and by turning the reader on ONLY when the car is really under it, the READ zone is detrimentally limited increasing the risk of a tag not being read at all i.e. a missed tag. A second prior art method of early-read prevention comprises designing a method which measures the time delay between reader-transmitted and tag-reflected signals, having an acceptable predetermined time delay yield a properly timed transponder response. However, this method is very costly and needs an averaging scheme at these short distances.

SUMMARY OF THE INVENTION

The solution to the abovementioned problem according to a preferred embodiment of this invention entails introducing a second antenna positioned at point A, the point from which reflections originate, disposed on the canopy, shown in FIG. 1, which transmits a "jamming" signal in such a way that it blocks the downlink poll message transmitted by the actual reader system. A Title-21 compatible backscatter-based transponder system has a downlink and uplink scheme as depicted in FIG. 2. The poll message, or downlink signal, sent from the reader to the tag is a 300 kBd Manchester-encoded, AM modulated signal. The poll message is received and detected by the tag, decoded for valid CRC, after which the tag will respond with a certain message (depending which type of poll message was transmitted). If anything goes wrong during this poll reception by the tag, the wrong CRC will result and the tag will not respond to the poll. This is exactly what the early-read inhibitor does: a 915 MHz, 300 kHz modulated signal is sent out by a second, small antenna which is located at the point from which the reflections originate (Point A). The 300 kHz AM modulation yields a worst-case signal for the 300 kbps Manchester modulation normally used for the poll message. Therefore, the 300 kHz AM signal will jam the tag's poll message reception extremely effectively, as it focuses the spectral energy exactly where it interferes most with the poll message. In conclusion, the "jamming signal" prevents the transponder from responding to rogue reflected interrogation signals.

One advantage achieved by this invention is an increase in the noise immunity of an AVI system, wherein the noise is rogue poll messages.

A second advantage achieved by this invention is the increase in the reliability and the robustness of the system, i.e. removal of early-read messages received and better efficiency in the interrogation/response protocol.

A third advantage this invention offers to AVI systems is that implementation of this invention is compatible with existing AVI system components and invisible to other ETC hard and software.

A fourth advantage this invention offers to RF-ID systems is that this solution is a real time solution, with results evidencing improvements in system performance immediately.

A fifth advantage this invention offers is that the system allows for tailoring the desired read spot when using a combination of jammer antennas.

A sixth advantage this invention offers is the comparatively low cost with regard to other potential solutions to the same problem.

BRIEF DESCRIPTION OF THE DRAWINGS

The invention will be explained in greater detail with reference to an example of an embodiment shown in the drawings, in which.

DETAILED DESCRIPTION OF PREFERRED EMBODIMENTS

Figure 1:
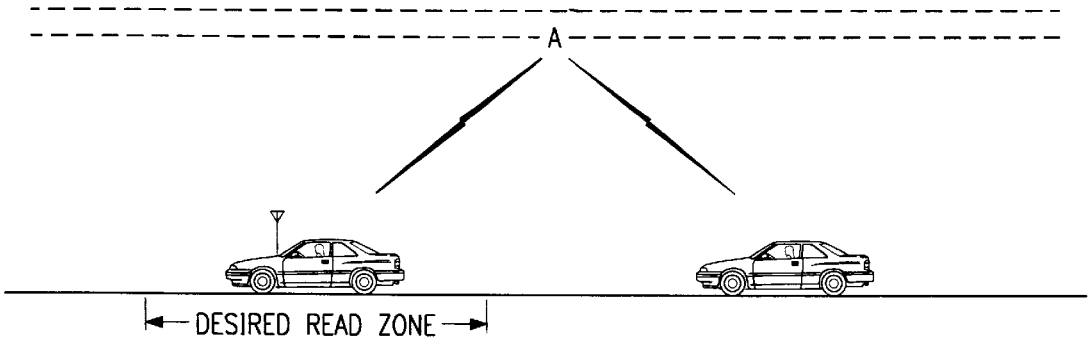
FIG.1 is a diagram depicting the location of the "jammer" antenna.
Figure 2:
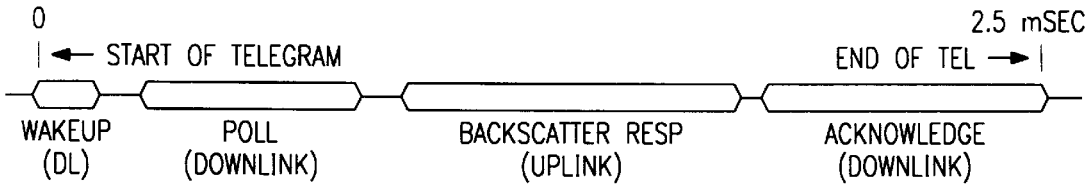
FIG. 2 is a timing diagram of the downlink and uplink of a Title-21 compatible backscatter-based transponder system according to a preferred embodiment of this invention.

The solution to the abovementioned problem according to a preferred embodiment of this invention entails introducing a second antenna positioned at point A disposed on the canopy, shown in FIG. 1, which transmits a "jamming" signal in such a way that it blocks the downlink poll message transmitted by the actual reader system. A Title-21 compatible backscatter-based transponder system has a downlink and uplink scheme as depicted in FIG. 2. The poll message sent from the reader to the tag is a 300 kBd Manchester-encoded, AM modulated signal. The poll message is received and detected by the tag, and then decoded for valid CRC, wherein the integrity of the received poll message is proved using Cyclic Redundancy Checking.

Cyclic Redundancy Checking is performed by adding an additional block of bits to each interrogation poll message data stream. This additional block of data bits is calculated by applying a specific algorithm to the poll message data bits to yield a interrogator specific CRC. During the manufacturing of the transponder, both the unique identification number of the transponder and the CRC will be programmed into the transponder. Then, during the polling phase, the transponder receives the poll message and the CRC. The transponder calculates from the received poll message data, the new CRC using the same CRC algorithm that the interrogator used to generate the CRC in the poll message. A comparison of the two, received poll message CRC and newly calculated CRC provides evidence as to the validity of the received poll message data i.e. if both CRC's are equal, then the received poll message data are valid, and if the CRC's are not equal, then the received poll message data are not valid. If the data are not valid as indicated by the CRC, then the tag will not respond with the predetermined response message (depending which type of poll message was transmitted).

Figure 4:
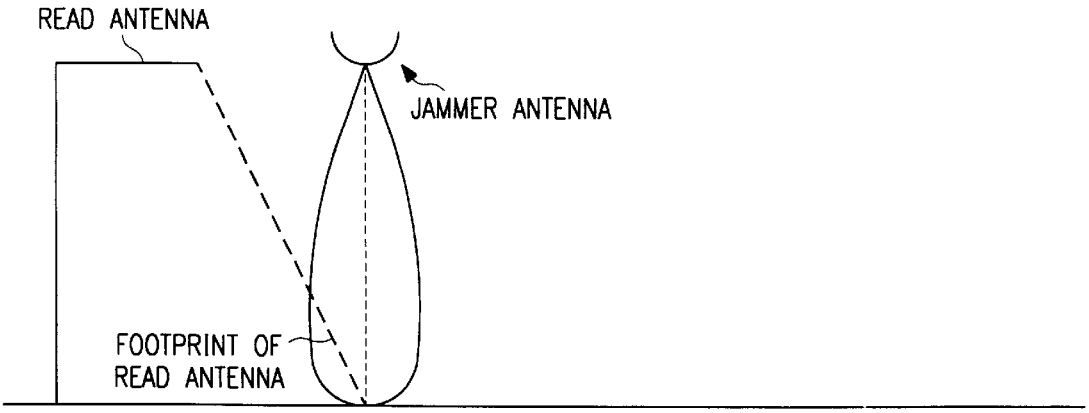
FIG. 4 is a diagram which provides further information on the location of the "jammer" antenna.

The early-read inhibitor provides a rogue interrogation poll message to inhibit the transponder from responding to these reflected poll messages. The rouge interrogation poll is created by the jammer which distorts the poll message from the interrogator, assuming the tag is located in the zone where the undesired reflections are present which is also the area at which the jammer antenna is aimed. The jamming signal consists of a 915 MHz, 300 kHz modulated signal and is sent out by a second, small antenna which is located at the point from which the reflections originate (Point A). This point is better defined as the point vertically aligned from the furthest point of the reader antenna footprint, located on the top of the canopy, as shown in FIG. 4. Therefore as a result, the tag receives a poll message as well as a 300 kHz AM modulated jam signal. The 300 kHz AM modulated jam signal distorts the received poll message, i.e. some bits will flip either in the data block check character (BCC) or the cyclic redundancy checking (CRC) block, which makes the (CRC) comparison between the received checksum and calculated checksum on the tag to fail. A failed CRC causes the transponder to not respond, which is a basic tag function.

The 300 kHz AM modulation yields a worst-case signal for the 300 kbps Manchester modulation normally used for the poll message. The digital explanation behind this conclusion is that in Manchester encoding a digital '0' is represented by a "01" combination and a digital '1' is represented by a "10" combination. If one puts out a serial bitstream of '0''s at 300 kbps, the result after Manchester encoding will be blocks of "01" (low-high) at 300 blocks per second. This is the same as a square wave of 300 kHz. Similarly, putting out a bit stream of '1's at 300 kbps also results in a square-wave signal of 300 kHz, but the signal will now be shifted 180 degrees, as the encoded data stream starts with a "10" block instead of a "01". If one were yet to put out a data stream of 101010101 (before encoding; thus a checkerboard pattern) the resulting Manchester encoded signal would result in a 150 kHz square wave, thus half the frequency(10011001100110). These are the three extremes: either 300 kHz in a 0 or 180 degree phase, or 150 kHz in a checkerboard data pattern. This means the 300 kHz is the highest fundamental frequency in a Manchester encoded bitstream when driven by a 300 kBd data signal. As a result, overlaying this signal with an additional 300 kHz sine or square wave, i.e. the jamming signal, will result in the most effective means to 'jam' the original signal, i.e. to insure that at least one bit will flip, thus rendering the poll message garbled.

The frequency domain explanation that the jamming signal is the worst case scenario for the interrogation signal follows. When one analyzes a 300 kBd, Manchester encoded data stream on a spectrum analyzer (or mathematically by means of a fourier transformation of the Manchester signal in the time domain), one will see the most prominent frequency component present in the spectrum will be a 300 kHz signal, which means that most of the energy is focused at 300 kHz. Therefore jamming the 300 kBd interrogation signal with a continuous jamming signal that also has it's energy focused at 300 kHz (a 300 kHz sine wave, a 300 kHz square-wave or anything in between these two extreme signal wave forms that has a 300 kHz frequency) will assure the most effective method to garble the original poll message, i.e. insure that at least one bit in the original poll message will flip. Therefore, the 300 kHz AM signal will jam the tag's poll message reception extremely effectively, as it focuses the spectral energy exactly where it interferes most with the poll message. In conclusion, the "jamming signal" prevents the transponder from responding to rogue reflected interrogation signals. The chances that the garbled data block and the garbled CRC will yield a valid CRC when the tag performs the CRC calculation from the rouge interrogation signal received are astronomically small but not zero.

Figure 3:
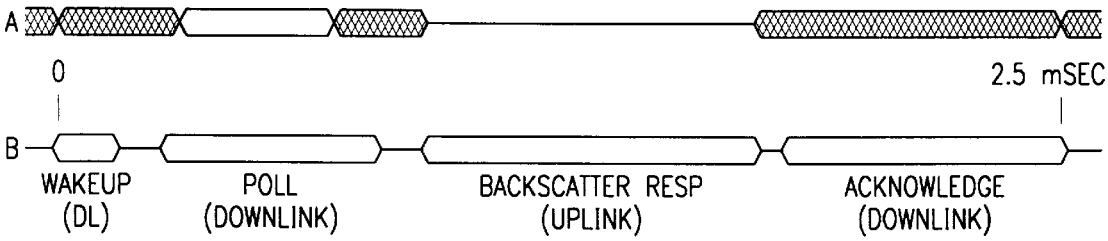
FIG. 3 is a timing diagram of the downlink/uplink protocol shown in FIG. 2 and the jamming signal as it compares to the downlink/uplink protocol.

The jammer must be synchronous with the interrogation system's "poll-to-poll" time or the time in which the interrogation cycles to the same state again. This will assure that the 300 kHz jam signal always coincides with the poll message, which is the message being targeted to garble. Other parts of the message (either from the interrogator or from the tag) during a poll cycle should not be affected, although there are don't care areas, as shown in FIG. 3. The start of the jamming signal is controlled by the beginning of the read cycle or time "0" as shown in FIG. 3. The length of the jamming signal should be such that it overlaps the duration of the poll message, but it should STOP when the tag starts it's much weaker uplink signal, as shown in FIG. 3. FIG. 3 shows 'A' as the jamming signal and 'B' as the reader/transponder signal. The XXX indicates "don't cares" during which the jamming signal could be transmitted but it is not essential.

Synchronization between the jam signal and the interrogator downlink signal (which contains the poll message) can be accomplished in at least two ways. Synchronization could be achieved by hardwiring the jammer electronics to the signal present in the transponder which indicates the beginning of an interrogator poll cycle or "time zero". The jammer box will start as soon as it receives this trigger, and shut-off after a predetermined amount of time(preprogrammed ahead of time). The jammer should stop transmitting the jammer signal BEFORE the poll message is over, otherwise it will jam the tag's uplink signal which is undesired, as this signal is much weaker than the interrogator's down-link signal. If the jammer does transmit during the up-link signal of a tag located within a desirable read area, the tag's up-link signal will not be read due to the jamming signal overpowering the up-link signal at the interrogator receiver(See FIG. 3.).

Alternatively, synchronization between the jam signal and the interrogator downlink signal may be accomplished by adding electronics to the jammer box that can recognize the beginning of a poll sequence in the serial downlink bitstream. Each poll sequence starts with a known preamble signal, which is always the same, no matter what data (i.e. read: poll type) is being sent to the tag. This known preamble consists of, for example, 33 μseconds of 300 kHz, then 100 μseconds of silence and then an AAC preamble right before the poll message (AAC being 101010100011). By decoding either the 33 μseconds of 300 kHz or the AAC bitstream (or both) the jammer knows when the poll message is about to begin, and is operable to turn itself on for the time that the poll message is being transmitted but no longer. The additional electronics in the jammer box method of synchronizing the jammer signal with the interrogator down-link signal requires more electronics but saves having to install a synchronization wire in the application, the latter method resulting in more cost from an overall system standpoint.

Although a preferred embodiment according to the invention has already been described with regard to the configuration of the jamming signal, this was not intended to limit the scope of the invention as the jamming signal can be created in a multitude of ways. For example, the jamming signal modulation can be another frequency other than 300 kHz, or even a carrier frequency. The jamming signal can be modulated in ways other than Amplitude Modulation, such as Frequency Modulation (FM), or Pulse Code Modulation (PCM), etc. The jamming signal could also be transmitted for longer duration's, i.e. for the entire interrogation cycle, or shorter duration's i.e. a single pulse, if necessary positioned in time to "fool" the tag's lane discriminator (i.e. cause the CRC generated to be invalid) yielding the same result. The jamming signal could also originate from a physical point other than Point "A" of FIG. 1. The jamming signal could also originate from a multitude of antennas instead of just one. The jamming signal also doesn't have to be the same frequency as the interrogation poll message. In multilane AVI environments a signal jammer transmitter can supply jamming signal for more than one jammer antenna.

In addition, this invention lends itself to systems other than backscatter based AVI systems, i.e. half-duplex based RF-ID systems, active backscatter(backscatter using an RF amplifier), passive backscatter (using a modulated dipole), active systems(systems with the transmitter on the tag), inductive systems; half-duplex, or full-duplex(the tag is powered by the interrogation signal). The downlink of an ACTIVE tag can also be jammed to prevent this problem. In further detail of the ACTIVE tag scenario, an active tag is a tag with an independent oscillator(transmitter) located within the tag, which is modulated by the uplink data, where a backscatter based tag has only a passive antenna on it which is shorted or opened depending upon the up-link data. An active tag-based system will also have some means that the interrogator uses to activate the tag to send it's uplink message, or, the interrogator must poll the active tag before the tag can respond. This poll message can be a simple RF pulse from the reader, but it can also be a more complex data pattern like our tag uses. In any case, this activation message can ALSO be jammed which would yield the same result, i.e. the tag not responding in areas where it should not be responding.

The preferred embodiments described above may be implemented in hardware or software and neither implementation is intended to be outside the scope of this invention. A few embodiments have been described in detail herein above. It is to be understood that the scope of the invention also comprehends embodiments different from those described, yet within the scope of the invention.

I claim:

1. A method for preventing rogue reads in an AVI system comprised of a reader with a read antenna and a transponder comprising:

transmitting a poll message from a read antenna of a reader to a transponder and having said poll message reflect from an undesirable location creating an undesirable poll message;

transmitting a jamming signal from a point from which undesired poll messages originate for creating a rogue poll message; and, receiving said rogue poll message by said transponder, thereby preventing said transponder from responding.

2. The method of claim 1, wherein said poll message comprises data and a CRC in the form of digital bits.

3. The method of claim 2, wherein said rogue poll message is said poll message with at least one bit flipped.

4. The method of claim 3, wherein said preventing said transponder from responding further comprises the steps of:

calculating from said rogue poll message an invalid CRC in response to said flipped bit; and comparing said invalid CRC with said received CRC and not responding when said invalid CRC and said received CRC are not equal.

5. The method of claim 1, wherein said jamming signal is transmitted at the same frequency as said poll message.

6. The method of claim 1, wherein said poll message and said jamming signal are synchronous in operation.

7. The method of claim 6, wherein said jamming signal transmission is terminated prior to the termination of said poll message.

8. The method of claim 1, wherein said jamming signal interferes with said undesirable poll message thereby creating said rogue poll message.

9. The method of claim 2 wherein upon receipt of said poll message, said transponder calculates a CRC and then compares said calculated CRC with said received CRC and responds only upon a match between said calculated CRC and said received CRC.

10. The method of claim 1, wherein said read antenna has a footprint of read range which defines said read antennas furthest point of read range.

11. The method of claim 10, wherein said point from which undesired poll messages originate is the point vertically aligned with the furthest point of said footprint.

12. The method of claim 11, wherein said point vertically aligned with said furthest point of said footprint is located on the top of an AVI canopy.

13. A method for preventing rogue reads in an RF-ID system comprised of a reader with a read antenna and a transponder comprising:

transmitting a poll message from a read antenna of a reader to a transponder and having said poll message reflect from an undesirable location creating an undesirable poll message;

transmitting a jamming signal from a point from which undesired poll messages originate for creating a rogue poll message; and, receiving said rogue poll message by said transponder, thereby preventing said transponder from responding.

14. The method of claim 13, wherein said poll message comprises data and a CRC in the form of digital bits.

15. The method of claim 14, wherein said rogue poll message is said poll message with at least one bit flipped.

16. The method of claim 15, wherein said preventing said transponder from responding further comprises the steps of:

calculating from said rogue poll message an invalid CRC in response to said flipped bit; and comparing said invalid CRC with said received CRC and not responding when said invalid CRC and said received CRC are not equal.

17. The method of claim 13, wherein said jamming signal is transmitted at the same frequency as said poll message.

18. The method of claim 13, wherein said poll message and said jamming signal are synchronous in operation.

19. The method of claim 18, wherein said jamming signal transmission is terminated prior to the termination of said poll message.

20. The method of claim 13, wherein said jamming signal interferes with said undesirable poll message thereby creating said rogue poll message.

21. The method of claim 14 wherein upon receipt of said poll message, said transponder calculates a CRC and then compares said calculated CRC with said received CRC and responds only upon a match between said calculated CRC and said received CRC.

22. The method of claim 13, wherein said read antenna has a footprint of read range which defines said read antennas furthest point of read range.

23. The method of claim 22, wherein said point from which undesired poll messages originate is the point vertically aligned with the furthest point of said footprint.

24. The method of claim 23, wherein said point vertically aligned with said furthest point of said footprint is located on the top of a canopy.

* * * * *